United States Patent [19]

Maruyama et al.

[11] Patent Number: 4,540,916

[45] Date of Patent: Sep. 10, 1985

[54] ELECTRON GUN FOR TELEVISION CAMERA TUBE

[75] Inventors: Masanori Maruyama, Kokubunji; Masakazu Fukushima, Tokyo; Shinichi Kato, Mobara; Chihaya Ogusu, Tokyo, all of Japan

[73] Assignees: Nippon Hoso Kyokai; Hitachi, Ltd., both of Tokyo, Japan

[21] Appl. No.: 437,335

[22] Filed: Oct. 28, 1982

[30] Foreign Application Priority Data

Oct. 30, 1981 [JP] Japan ..... 56-173003
Oct. 30, 1981 [JP] Japan ..... 56-173004

[51] Int. Cl.[3] ..... H01J 29/46; H01J 29/56
[52] U.S. Cl. ..... 315/16; 313/449
[58] Field of Search ..... 315/15, 16, 382, 31 R, 315/31 TV; 313/448, 449, 452

[56] References Cited

U.S. PATENT DOCUMENTS 3,417,199 12/1968 Yoshida et al. ..... 315/14
3,873,878 3/1975 Odenthal ..... 313/449
3,924,153 12/1975 McIntyre ..... 315/14
3,928,784 12/1975 Weijland ..... 313/448
3,995,194 11/1976 Blacker, Jr. et al. ..... 315/382
4,388,556 6/1983 Rao ..... 313/389

FOREIGN PATENT DOCUMENTS 2201536 4/1974 France .
2237308 2/1975 France .
2417182 9/1979 France .
54-14154 2/1979 Japan ..... 313/449

*Primary Examiner*—Theodore M. Blum
*Attorney, Agent, or Firm*—Antonelli, Terry & Wands

[57] ABSTRACT

An electron gun for a television camera tube comprises a cathode for emission of electrons, a first grid disposed subsequently to the cathode and having a first aperture supplied with a positive voltage relative to the cathode, a second grid disposed subsequently to the first grid and having a second aperture supplied with a higher positive voltage than that supplied to the first grid, and an intermediate grid interposed between the first and second grids and having a hole. The intermediate grid forms a divergent electron lens near the first aperture between the first and second grids. An electron beam having passed through the first aperture is once diverged by the divergent electron lens to form a crossover at an axial position of the gun which is remote from the first grid and at which the potential on the beam axis is high, whereby broadening of the width of the velocity distribution of extracted electrons can be suppressed to a minimum and the amount of beam current passing through the second aperture can be increased.

23 Claims, 19 Drawing Figures

ELECTRON GUN FOR TELEVISION CAMERA TUBE

CROSS-REFERENCES OF THE RELATED APPLICATIONS

This application relates to a copending U.S. application Ser. No. 315,869 entitled "Electron Gun" filed by Masakazu Fukushima et al., Oct. 28, 1981 and assigned to the present assignees.

The present invention relates to an electron gun for a television camera tube and more particularly to an electrode structure for a diode type electron gun which can suppress the undesirable broadening of the velocity distribution of electrons in an electron beam generated thereby.

In a vidicon type television camera tube, an electric charge pattern corresponding to the illumination pattern of an object is generated on a photoconductive layer, the electric charge of the pattern is successively discharged by scanning an electron beam generated from an electron gun over the surface of the photoconductive layer, and charging currents corresponding to the successive discharging points on the photoconductive layer are taken out as signals to the outside. Usually, the electric charge once generated in the presence of the object is not entirely discharged during one beam scanning operation, so that even after disappearance of the object, a spurious signal corresponding to the residual electric charge causes a signal lag during the next scannings, thus degrading the picture quality particularly of a picture involving moving objects.

Especially, in a television camera tube using a blocking type photoconductive layer, a signal lag having a time constant which is determined by the product of the electrostatic capacitance of the photoconductive layer and the beam resistance of the scanning electron beam is predominant and it is usually called a beam-discharge signal lag. The beam resistance corresponds to the velocity distribution of electrons in the electron beam and for realization of a low signal lag, the width of velocity distribution of electrons in the electron beam is required to be narrow.

As is well known in the art, electrons emitted from the cathode have a velocity distribution subject to a Maxwellian distribution but in the course of decreasing the beam spot size, the current density of the electron beam increases and energy relaxation due to Coulomb force interaction between the electrons broadens the velocity distribution, thus degrading the signal lag characteristics. This phenomenon is called the Boersch effect and it is taught thereby that the broadening rate of the velocity distribution is substantially in proportion to $J(Z)^{\frac{1}{3}}/V(Z)^{\frac{1}{2}}$ where J(Z) represents the current density on the beam axis and V(Z) represents the potential on the beam axis.

Accordingly, in an electron gun designed to provide a low signal lag, the current density of the electron beam should be suppressed to as small a value as possible and to this end, a diode type electron gun has been proposed wherein a first grid opposing the cathode is supplied with a positive potential relative to the cathode.

An ideal low-signal-lag electron gun has to have a so-called laminar flow electron beam in which electrons are emitted from the cathode in parallel with the axis so as not to form a crossover point at which there necessarily exists a high current density. However, in order to avoid insufficient intensity of an electron beam in the presence of high illumination of a picked up object, an electron gun for a television camera tube requires a so-called automatic beam optimizer (abbreviated as ABO) wherein the voltage applied to a first grid is controlled in accordance with the illumination of the object so that the density of the emission current from the cathode is increased to thereby generate a large amount of beam current. Thus, because of the necessity for broadening the dynamic range of the beam current amount, the conventional diode type electron gun is of the crossover type, especially, with a crossover point formed at a low potential on the beam axis near the first grid, and is unsatisfactory for suppressing the broadening of the velocity distribution.

This invention intends to improve the conventional diode type electron gun and has for its object to provide an electron gun which is capable of generating a larger amount of beam current under lower signal lag and lower cathode loading (i.e., cathode emission current density) conditions.

In a diode type electron gun according to the invention, a divergent electron lens is formed near an aperture of the first grid in the beam traveling direction, and the electron beam emitted from the cathode and having passed through the first grid aperture is once diverged to form a crossover at a high potential point on the tube axis remote from the first grid aperture, whereby broadening of the velocity distribution of electrons in the electron beam can be suppressed to a minimum and at the same time the amount of beam current passing through the aperture of a second grid can be increased.

The present invention will be apparent from the following detailed description taken in conjunction with the accompanying drawings, in which.

For a better understanding of the invention, the construction of a vidicon type television camera tube will first be described briefly and a prior art diode type electron gun will then be described.

Figure 1:
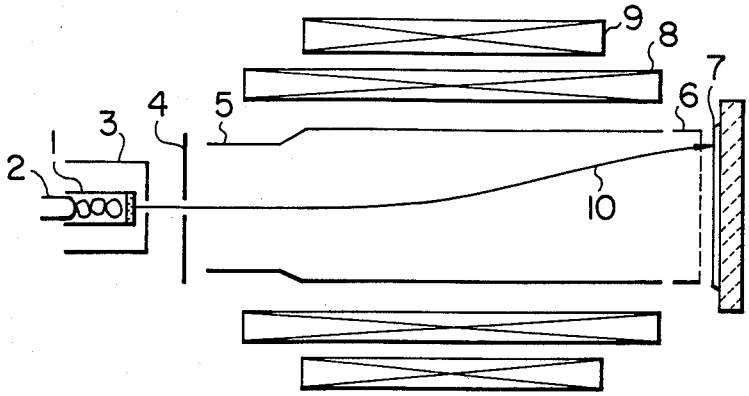
FIG. 1 is a schematic diagram of a television camera tube.

Of various types of vidicon type television camera tubes presently available, an electromagnetic focusing and electromagnetic deflection type television camera tube is taken as an example and will be described with reference to FIG. 1.

As schematically shown therein, the vidicon type television camera tube has a thermionic cathode 1, a heater 2, a first grid 3, a second grid 4, a third grid 5, a fourth grid 6 in the form of a mesh electrode, a photoconductive layer forming a target 7, a focusing coil 8, and a deflection coil 9. An electron beam 10 emitted from the cathode 1 is decreased in beam cross-section by an electrostatic electron lens comprised of the first and second grids 3 and 4, focused on the target 7 by a magnetic lens formed by the focusing coil 8, and scanned by a magnetic field generated by the deflection coil 9. The electromagnetic focusing and electromagnetic deflection type television camera tube is exemplified herein only for illustration purposes, and the invention essentially pertains to an improvement in the portion of electron gun including the first and second grids 3 and 4 and is applicable to any types of television camera tube regardless of the type of beam focusing and deflection.

Figure 2:
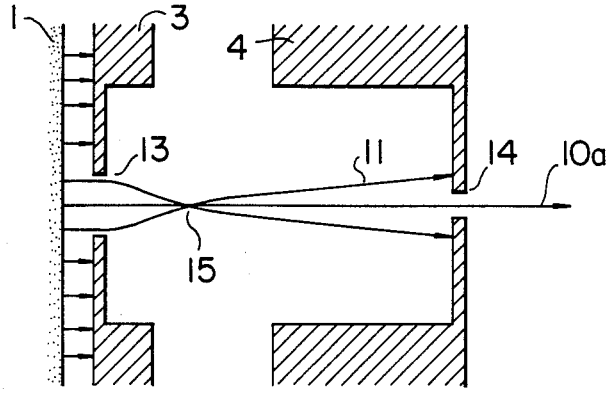
FIG. 2 PRIOR ART
FIG. 2 is an enlarged sectional view showing an essential part of a prior art diode type electron gun.

A prior art diode type electron gun, an essential part of which is shown in an enlarged sectional form in FIG. 2, has a cathode surface 1, a first grid 3 formed with an aperture 13, and a second grid 4 formed with an aperture 14. Electrons emitted from a central part of the cathode surface 1 travel along a locus 10*a*. The first grid 3 is supplied with a positive voltage of 3 to 20 volts and the second grid 4 with a positive voltage of about 300 volts relative to the cathode at 0 (zero) volt.

An electron beam having passed through the first grid aperture 13 is focused near the aperture 13 to form a crossover 15 near the first grid 3.

Figure 3:
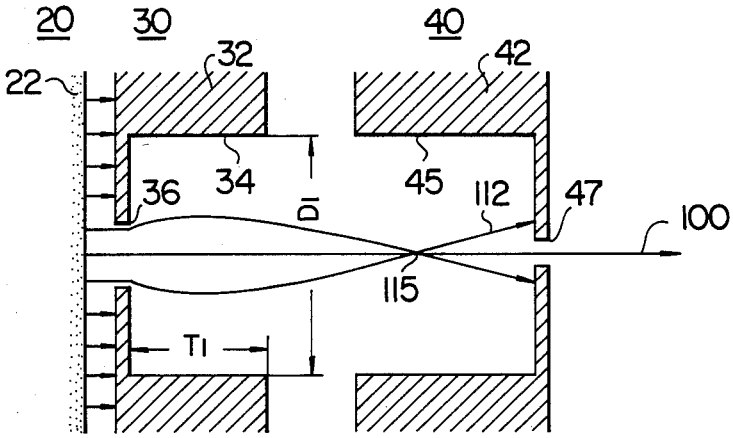
FIG. 3 is an enlarged sectional view showing an essential part of a diode type electron gun embodying the invention.
Figure 4:
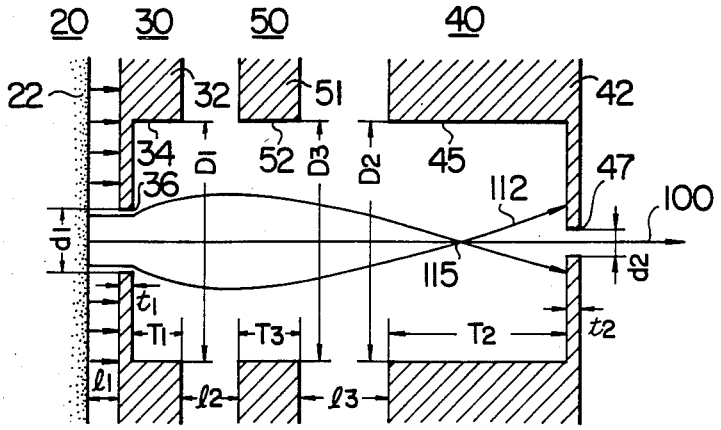
FIG. 4 is a similar view of the diode type electron gun according to another embodiment of the invention.

Referring now to FIGS. 3 and 4, embodiments of a diode type electron gun according to the invention will be described. In a first embodiment, an essential part of which is shown in enlarged sectional form in FIG. 3, a first grid 30 has a thick disk block 32 formed with a central recess 34 of an inner diameter $D_1$ and a depth $T_1$ with a relation of $T_1 > D_1/2$ being retained. The deep recess is effective to shield the electric field generated by a second grid 40 opposing the first grid 30 so that a divergent lens is formed near the aperture 36 of the first grid 30 on the side of the recess 34. Consequently, an electron beam 112 having passed through the aperture 36 is once diverged to form a crossover 115 on the gun axis remote from the first grid aperture 36 in the region of the second grid 40. An electron emitted from the center of a cathode surface 22 of cathode 20 in the axial direction runs along a locus 100. The second grid 40 has a disk block 42 formed with a recess 45 and an aperture 47.

In the second embodiment as shown in FIG. 4, an intermediate grid 50 having a disk 51 formed with a hole 52 is interposed between the first grid 30 and the second grid 40. The intermediate grid 50 is adapted to form a divergent lens near the aperture 36 of the first grid 30. The intermediate grid 50 is preferably supplied with a voltage which is equal to or lower than the voltage applied to the first grid 30. More preferably, the intermediate grid 50 and a cathode 20 are maintained at the same potential, thereby preventing an unwanted increase in the number of stem lead wires. In FIGS. 3 and 4, like reference numerals designate like elements.

Figure 5:
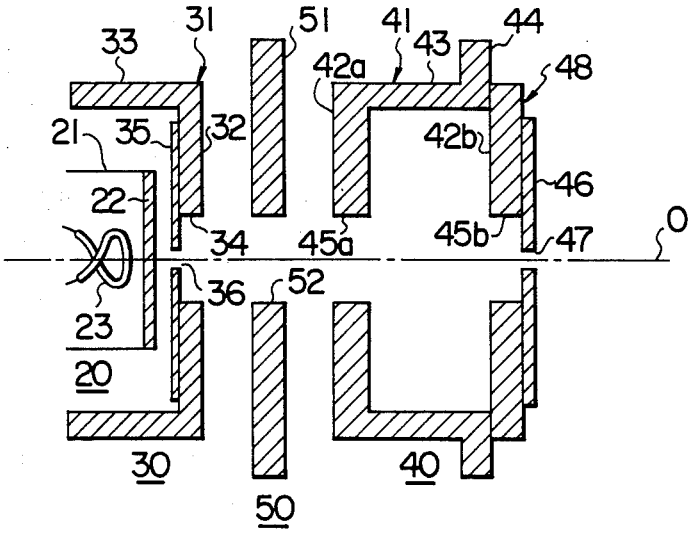
FIG. 5 is a sectional view showing the entire structure of the FIG. 4 electron gun.

FIG. 5 shows, in section, an overall structure of an electron gun of the invention incorporating the portion thereof as shown in FIG. 4. The electron gun comprises a thermionic cathode 20 comprised of a cylindrical sleeve 21 having a closed righthand end 22 and a heater 23 contained in the cylindrical sleeve 21. The closed end 22 has a pellet made of an electron emission material, providing a planar cathode surface. The heater 23 generates heat necessary for causing the pellet of the cathode surface to emit electrons. The first grid 30 close to the thermionic cathode 20, the intermediate grid 50 and the second grid 40, which are concentric with a center axis 0, are spaced from each other.

The first grid 30 includes a cup-shaped base electrode 31 and a disk 35. The cup-shaped base electrode 31 has a plate portion 32 disposed in proximity to and substantially in parallel with the cathode surface, and a cylindrical portion 33 which is concentric with the sleeve 21, has a larger inner diameter than that of the sleeve 21, and extends toward the thermionic cathode 20. The plate portion 32 is formed with a central hole 34. Such a base electrode 31 can easily be produced by press work operations. The disk 35 has a diameter which is larger than that of the hole 34 and smaller than the inner diameter of the cylindrical portion 33, and it is disposed concentrically with the hole 34 to come into electrical contact with the cup-shaped base electrode 31, especially, with the one surface of the plate portion 32 facing the cathode surface. The disk 35 is decreased in thickness as compared to the plate portion 32 and has a central aperture 36 which is far smaller than the hole 34 in the plate portion 32 and is concentric therewith. Thus, the hole 34 in the base electrode 31 is partly closed by the disk 35 with the aperture 36 to form a recess having a diameter $D_1$ and a depth $T_1$ (see FIG. 4). The aperture 36 serves as an aperture for the first grid 30.

In the foregoing description, the first grid 30 is constituted by the separate cup-shaped base electrode 31 and disk 35 but the disk 35 may be integrated in the base electrode 31 if the plate portion 32 is formed with a central circular recess as a substitute for the hole 34 and the recess is bored at the center to provide the aperture 36. Also, the aperture 36 may be tapered such that its diameter is minimal in the close proximity of the cathode surface and gradually increases in the direction away therefrom. With the tapered aperture 36, the increase in beam diameter due to scattered electrons generated at the inner wall of the aperture 36 can advantageously be suppressed.

Figure 8A:
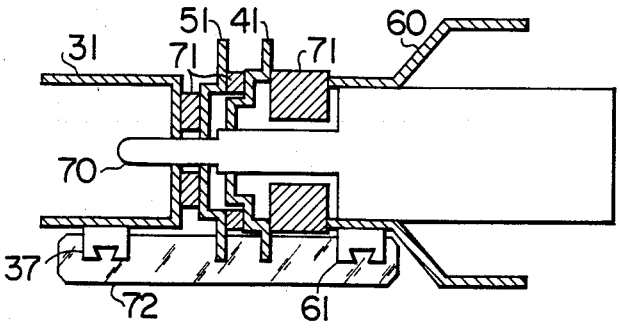
FIGS. 8A to 8D are fragmentary sectional views useful in explaining fabrication processes of the electron gun according to the invention.

The intermediate grid 50 includes a circular disk 51 which is disposed in proximity to and substantially in parallel with the plate portion 32 of the first grid 30. The disk 51 is formed with a central hole 52 having a diameter which is substantially equal to or larger than the diameter of the hole (recess) 34 of the adjoining first grid 30, with its center axis being coaxial with the tube axis 0 (depicted by a chained line in FIG. 5) of the electron gun. The disk 51 constituting the intermediate grid 50 may be a disk-shaped disk as shown in FIG. 8A.

One may prefer the disk-shaped disk to a planar disk since the former can readily be formed by press work operations and can be superior to the latter in strength.

The second grid 40 includes a cup-shaped base electrode 41 like the first grid 30, a thin disk 46, and an additional support plate 48 in the form of a circular disk. The cup-shaped base electrode 41 comprises a plate portion 42*a* disposed substantially in parallel with the plate portion 32 of the first grid 30, a cylindrical portion 43 which is coaxial with the first grid cylindrical portion 33, has substantially the same inner diameter as that of the portion 33 and extends in a direction away from the cathode 20, and a lip portion 44 at the farthermost distance from the cathode 20. The plate portion 42*a* has a central hole 45*a* of a diameter which is substantially equal to or larger than that of the hole 52 of the adjoining intermediate grid 50, with its center axis being coaxial with the tube axis 0 of the electron gun. The base electrode 41 may be formed by pressing. The support plate 48 is constituted by a circular disk 42*b* formed with a hole 45*b* having a diameter which is substantially equal to or larger than the diameter of the hole 45*a* in the plate portion 42*a*. The disk 42*b* is mounted on one surface of the lip portion 44 which is remote from the cathode surface with its hole 45*b* *substantially centered with the hole 45a,* so that the support plate 48 comes into electrical contact with the base electrode 41.

The thin disk 46 having an aperture 47 which is coaxial with the hole 45*b* in the support plate 48 is mounted on one surface of the disk 42*b*, which surface faces away from the cathode surface, so as to make electrical contact with the support plate 48 and base electrode 41. Thus, the hole 45*b* in the disk 42*b* is partly closed by the disk 46, whereby the plate portion 42*a* of base electrode 41 cooperates with the disk 42*b* of support plate 48 to form the effective disk block 42 (see FIG. 4) of the second grid 40 and the hole 45*a* cooperates with the hole 45*b* to form the effective recess (hole) 45 (See FIG. 4) having a diameter $D_2$ and a depth $T_2$.

The disk 46 is thinner than the effective disk block 42 and has a central aperture 47 of a diameter which is far smaller than that of the effective hole 45 of the disk block 42. This aperture 47 serves as an aperture for the second grid 40. While in the foregoing description the base electrode 41 cooperates with the support plate 48 to constitute the effective disk block 42 and the hole 45, this structure is in no way limitative. For example, without the support plate 48, the plate portion 42*a* of base electrode 41 may be made thicker so that the hole 45 may be formed in the center of the plate portion 42*a* and the disk 46 may be disposed directly on the plate portion 42*a*. This modification is particularly effective when the thickness $T_2$ (depth of the recess 45) of the effective disk block 42 is not so large. In a further alternative, without the disk 46, the second grid may be constituted with a base electrode alone by forming a recess of diameter $D_2$ and depth $T_2$ in a plate portion of this base electrode and forming an aperture 47 in the center of the recess. Further, the configuration of the base electrode 41 is not limited to a cup shape but may be of various shapes including a multiple cup shape as shown in FIG. 8A.

The electron gun of the invention will now be described in more detail by way of the structure of FIG. 4 by referring to specified numerical values of dimensions.

Preferably, the grids are so arranged that a gap $l_1$ between the cathode 20 and the first grid 30 (between the cathode surface 22 and disk 35 (FIG. 5)) is about 0.07 to 0.2 mm, a gap $l_2$ between the first grid 30 and intermediate grid 50 (between the disk block 32 of first grid and disk 51 of the intermediate grid) is about 0.1 to 0.5 mm, and a gap $l_3$ between the intermediate grid 50 and second grid 40 (between the disk 51 of the intermediate grid and disk block 42 of the second grid) is about 0.2 to 1.5 mm.

The disk block 32 of the first grid has a thickness $T_1$ (depth of recess 34) of about 0.1 to 0.2 mm, the hole forming the recess 34 has a diameter $D_1$ of about 0.4 to 1.0 mm, the disk 35 has a thickness $t_1$ of about 0.02 to 0.05 mm, and the aperture 36 has a diameter $d_1$ of about 0.01 to 0.3 mm.

The effective disk block 42 of the second grid has a thickness $T_2$ (depth of recess 45) of about 0.1 to 1.0 mm when this thickness corresponds to the distance in the tube axis direction between the end surface, facing the cathode, of the plate portion 42*a* of base electrode 41 and the end surface, facing the cathode, of the disk 46 in the structure of FIG. 5 in which the second grid 40 is constituted with a plurality of component members 41, 46 and 48. The recess 45 has a diameter $D_2$ (corresponding to the diameter of the hole 45*a* formed in the plate portion 42*a* of base electrode 41 in FIG. 5) which is substantially equal to or at the most twice the diameter $D_1$, the disk 46 has a thickness $t_2$ of 0.02 to 0.05 mm which is equivalent to the thickness $t_1$, and the aperture 47 has a diameter $d_2$ of about 0.01 to 0.3 mm. In the intermediate grid 50, the disk 51 has a thickness $T_3$ of about 0.03 to 1.0 mm, and the hole 52 has a diameter $D_3$ which is substantially equal to or slightly larger than the diameter $D_1$.

Relative to 0 (zero) volt at the cathode 20, a relatively low positive voltage of about 3 to 15 volts, for example, is applied to the first grid 30, a voltage which is equal to or lower than that applied to the first grid, for example, zero volt for the cathode is applied to the intermediate grid 50, and a relatively high positive voltage of about 300 volts, for example, is applied to the second grid 40. Obviously, these voltages are fed from an external power supply to the television camera tube via stems provided at one end of a glass envelope opposite to the target.

Beam characteristics of the electron gun according to the present invention will now be described.

Figure 6A:
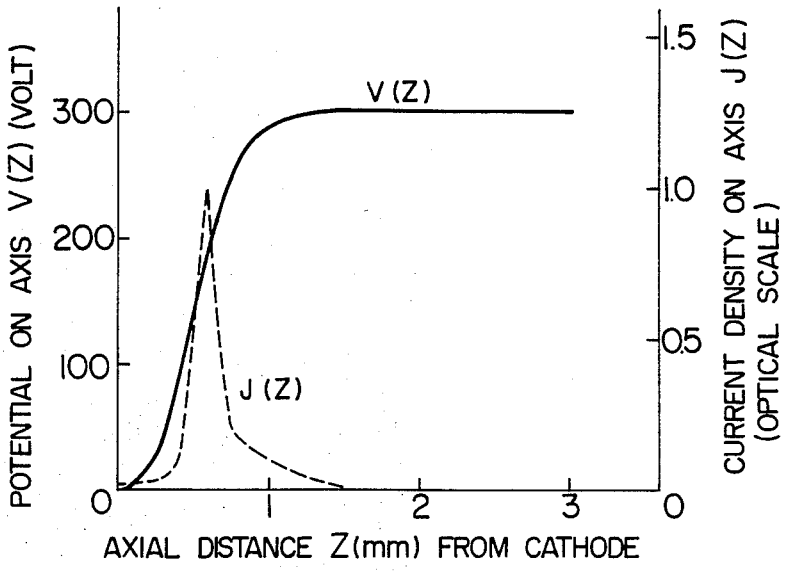
FIG. 6A PRIOR ART
FIG. 6A is a diagram showing the relation between the potential on the beam axis and the density of the current on the beam axis relative to the axial distance in the prior art electron gun.
Figure 6B:
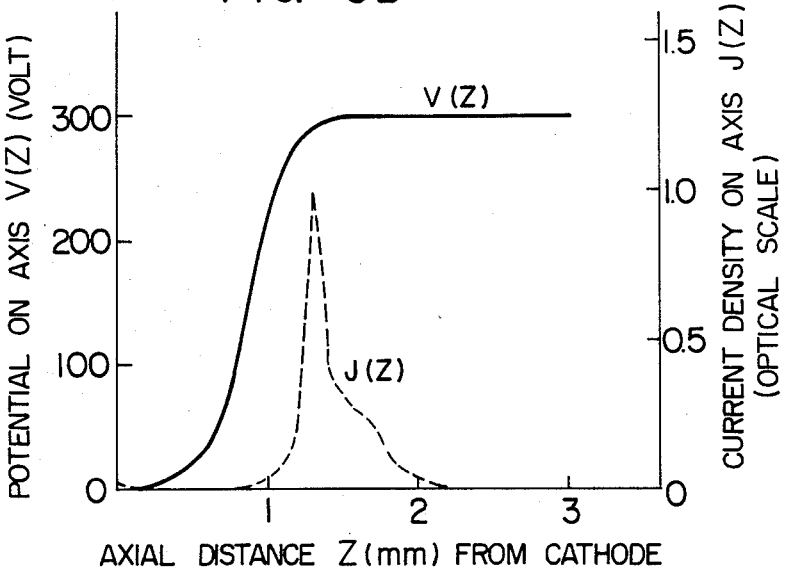
FIG. 6B is diagram showing a similar relationship in the electron gun of the invention.

FIG. 6A shows a potential characteristic on axis V(Z) and a current density characteristic on axis J(Z) relative to the axial distance z from the cathode in the prior art shown in FIG. 2, and FIG. 6B shows characteristics similar to FIG. 6A in the FIG. 4 electron gun according to the invention. When compared with the prior art characteristics shown in FIG. 6A, in the characteristics of the electron gun of the invention shown in FIG. 6B, the potential curve on axis V(Z) (solid line) rises gradually near the cathode, and the current density curve on axis J(Z) (dotted line) has a peak (corresponding to the crossover point) which is shifted in the direction away from the cathode to a point at which the potential on the beam axis is higher, i.e. being substantially equal to the potential of the second grid, thereby ensuring that broadening of the width of the velocity distribution in the electrons can be suppressed extensively.

Figure 7:
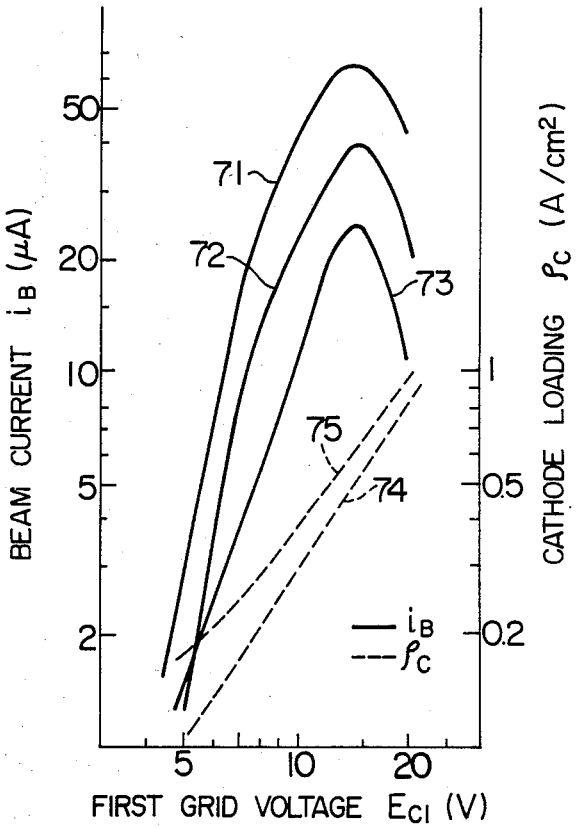
FIG. 7 is a diagram showing the beam current and cathode loading characteristics of the invention in comparison with those of prior art electron guns.

In comparison of specified examples 1 and 2 of the present invention with a prior art example shown in the following Table, FIG. 7 shows characteristics of beam current passing through the second grid aperture 47 and current density (cathode loading) $\rho_c$ at the center of the cathode relative to voltage $Ec_1$ applied to the first grid 30.

TABLE

| | Prior art example | Example 1 | Example 2 |
|---|---|---|---|
| $l_1$ | 0.15 mm | 0.15 mm | 0.15 mm |
| $t_1$ | 0.03 mm | 0.03 mm | 0.03 mm |
| $T_1$ | 0.15 mm | 0.15 mm | 0.15 mm |
| $d_1$ | 0.20 mm | 0.20 mm | 0.20 mm |
| $D_1$ | 0.65 mm | 0.65 mm | 0.65 mm |
| $l_2$ | — | 0.20 mm | 0.20 mm |
| $T_3$ | — | 0.25 mm | 0.25 mm |
| $l_3$ | — | 0.20 mm | 0.20 mm |
| $t_2$ | 0.03 mm | 0.03 mm | 0.03 mm |
| $T_2$ | 0.77 mm | 1.00 mm | 1.00 mm |
| $d_2$ | 0.03 mm | 0.03 mm | 0.02 mm |
| $D_2$ | 0.65 mm | 0.65 mm | 0.65 mm |
| Gap between first and second grids | 0.4 mm | — | — |
| Voltage applied to first grid | 3–20 V | 3–20 V | 3–20 V |
| Voltage applied to second grid | 300 V | 300 V | 300 V |
| Voltage applied to intermediate grid | — | 0 V | 0 V |

In FIG. 7 solid-line curves 71, 72 and 73 respectively represent characteristics of beam current $i_B$ according to examples 1 and 2 of the present invention and the prior art example, and dotted-line curves 74 and 75 respectively represent characteristics of cathode loading $\rho_c$ according to the electron gun of the invention (examples 1 and 2) and the prior art example. When comparing the characteristics of the electron gun of the invention with those of the prior art example on the basis of the characteristics of FIG. 7, curves 71, 72 and 73 clearly show that the value of beam current $i_B$ in the electron gun of the invention is larger than that in the prior art example for the same $Ec_1$ and that the beam current $i_B$ rises more rapidly in the invention than in the prior art example. This evidences the fact that the electron gun of the invention having the divergent lens achieves a more sharp beam focusing than the prior art example. On the other hand, a comparison of the cathode loading $\rho_c$ (see curves 74 and 75) shows that the value of the cathode loading in the electron gun of the invention is lower than that in the prior art example for the same $Ec_1$ and substantially coincides with the theoretical value pursuant to the Child-Langmuir formula which provides $\rho_c \propto Ec_1^{3/2}$. This is due to the fact that the gradual change in potential near the first grid aperture in the electron gun of the invention can shield effect of shield the effect of the electric field generated by the potential of the second grid. Contrary to this, in the prior art example, the change in potential near the first grid aperture is large and the effect of the electric field generated by the potential of the second grid causes a more intensive electric field to act on the center of the cathode, thereby raising the cathode loading. In particular, the above effect is remarkable for small values of $Ec_1$ and the cathode loading considerably deviates from the theoretical value.

In the diode type electron gun in which the first grid is supplied with a positive potential, the emission lifetime and reliability of the cathode is of the most importance. The present invention permits generation of larger beam currents at lower cathode loading as compared to the prior art example and is very advantageous from the standpoint of emission life-time and reliability of the cathode.

Further, as evidenced by examples 1 and 2, the electron gun of the invention does not decrease the beam current $i_B$ to a great extent even with the reduced diameter of the second grip aperture 47, thereby permitting the use of a smaller aperture than that of the prior art example, which can be advantageous for improving the resolution of the television camera tube.

As described above, according to the electron gun of the invention, the crossover point can be formed at a position at which the potential on the beam axis is high to suppress a broadening of the velocity distribution of the electrons and large beam currents can be generated at lower cathode loading, thereby realizing an electron gun which is very advantageous from the point of view of the life and reliability of the cathode, the improvement in resolution of the television camera tube and the reduction of signal lag.

Further, in the electron gun of the invention, by making large the inner diameter $D_2$ of the effective recess 45 (hole of the effective disk block 42) and the inner diameter $D_3$ of hole 52 of the intermediate grid, the amount of electron beam deflection due to eccentricity between individual grid electrodes can be suppressed to a minimum. This will be described in greater detail with reference to FIGS. 8A to 8D showing one example of fabrication processes for the electron gun of the present invention.

Illustrated in FIG. 8A are a third grid 60 (not directly related to the present invention), a center pin 70, spacers 71, glass beads 72, a fixture 37 for the first grid base electrode 31, and a fixture 61 for the third grid 60. As shown in FIG. 8A, the center axes and gaps of the grids are first set by means of the center pin 70 and spacers 71, and these grids are fixedly supported in position by means of the glass beads 72.

The present electron gun is featured in that the effective recess 45 (hole of the base electrode 41) of the second grid has a inner diameter $D_2$ which is larger than the inner diameter $D_3$ of the intermediate grid hole 52, for example, for $D_1=D_3=0.65$ mm $\phi$, $D_2$ is 0.9 mm $\phi$ which approximates $D_1+l_3=0.65+0.2=0.85$ mm. Other electrode dimensions are the same as those in the previous example 1.

Figure 8B:
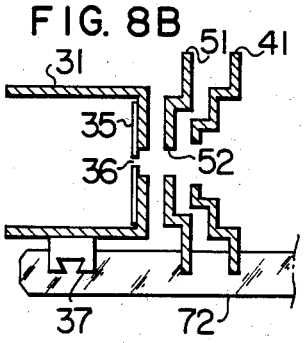
Figure 8C:
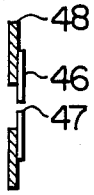
Figure 8D:
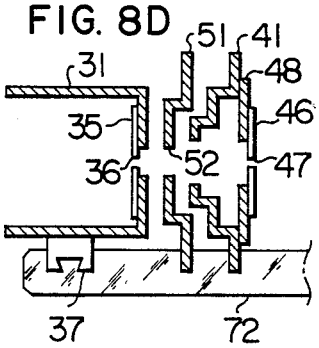

The united grids in this manner are then provided with the thin disks having apertures as follows. Firstly, as shown in FIG. 8B, the thin disk 35 having the aperture 36 is set on the first grid base electrode 31 by referencing the center axis of the hole 52 of intermediate grid electrode 51. Alternatively, an unapertured thin disk 35 may be fixed to the base electrode 31 of the first grid and thereafer the aperture 36 may be formed by laser machining by referencing the center axis determined from the circumference of the hole 52 of the intermediate grid electrode 51 by means of optical means, for example. The thin disk 35 may be provided with the aperture 36 formed by, for example, etching and set on the base electrode by referencing the center axis of the hole 52 of intermediate grid electrode 51. In this working process, by making the inner diameter $D_2$ of recess 45 (hole of the base electrode 41) of the second grid larger than the inner diameter $D_3$ of the hole 52 of the intermediate electrode 51 as in the present embodiment, the aperture 36 of the first grid can readily be centered with the hole 52 of the intermediate grid even when the intermediate grid and the second grid become off-centered with respect to each other. Next as shown in FIG. 8C, the thin disk 46 formed with the aperture 47 is fixed to the support plate 48. Subsequently, while keeping the first grid aperture 36 coaxial with the second grid aperture 47 (since under this condition the first grid aperture 36 is coaxial or centered with the intermediate grid hole 52, all of the first grid aperture 36, intermediate grid hole 52 and second grip aperture 47 becomes coaxial with each other), the support plate 48 is fixed to the base electrode 41. Thereafter, the cathode (not shown) is installed in the cup-shaped base electrode 31 of the first grid to complete assembling of the electron gun. Thus, according to this embodiment, all of the first grid aperture, intermediate grid hole and second grid aperture can readily be centered irrespective of any eccentricity between the electrodes due to, for example, tolerance between the outer diameter of the center pin and the hole of the base electrodes. Consequently, the amount of deflection of the electron beam dependent on the eccentricity between the electrodes can be suppressed and hence the diode type electron gun can be realized which has a divergent lens system of stable characteristics free from irregularity or nonuniformity in beam current characteristics.

Figure 9:
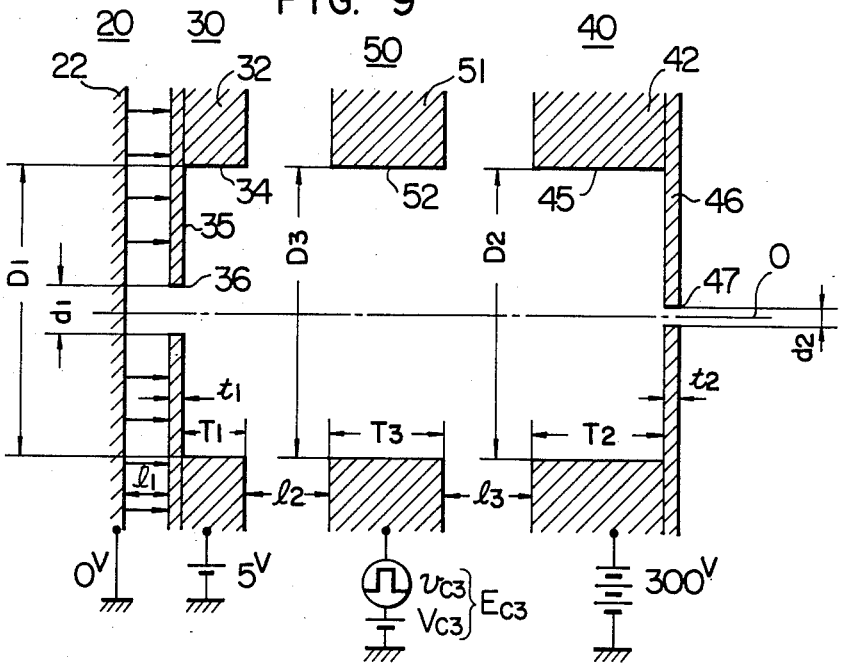
FIG. 9 is an enlarged sectional view showing an essential part of a further embodiment of the invention.

While in the foregoing description the voltage applied to the first grid is controlled to control the amount of beam current, the controlling voltage applied to the intermediate grid may substitute for the voltage control of the first grid in the electron gun of the invention in order that the amount of beam current can be controlled without appreciable change in the density of current emitted from the cathode to thereby further improve the life and reliability of the cathode. FIG. 9 shows, in enlarged sectional view, an essential part of a still further embodiment of the electron gun according to the invention, wherein a pulse voltage is applied to the intermediate grid to generate a large beam current. Throughout FIGS. 4, 5 and 9, like elements are designated by like reference numerals and will not be described herein. According to this embodiment, in a normal imaging operation, the cathode 120 is at zero volt, the first grid 30 is at about 5 volts, the second grid 40 is at about 300 volts, and the intermediate grid 50 is supplied with a predetermined voltage $V_{c3}$ of, for example, zero volt, so that a divergent electron lens can be formed near the first grid aperture and an electron beam having a decreased current density at a crossover point can be generated. When a high intensity of light is received, a pulse voltage $v_{c3}$ of, for example, 80 volts is superimposed on the predetermined voltage $V_{c3}$ of the intermeidate grid during only the period of scanning of electron beam on the photoelectric conversion surface in synchronism with the reception of the highly intensive incident light and a peak value $E_{c3}=V_{c3}+v_{c3}$ (volts) of voltage is applied to the intermediate grid, thereby performing an ABO operation by which the amount of beam current passing through the aperture 47 can be increased.

Figure 10:
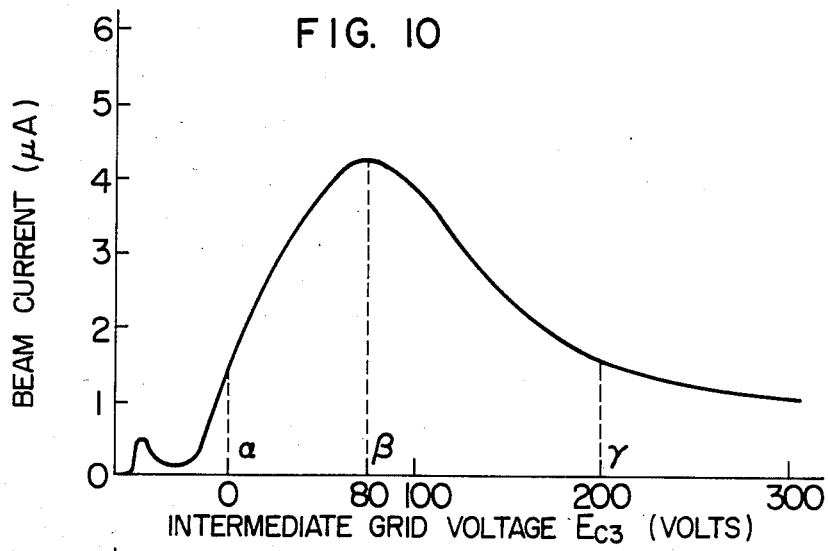
FIG. 10 is a diagram showing the relation between the voltage applied to the intermediate grid and the beam current.

To explain the relation between the voltage applied to the intermediate grid and the beam current, when the voltage value $E_{c3}$ applied to the intermediate grid is varied under the application of about 5 volts to the first grid and about 300 volts to the second grid in the electron gun (example 3) in which $l_1=0.1$ mm, $l_2=l_3=0.2$ mm, $T_1=0.13$ mm, $D_1=0.65$ mm, $t_1=0.03$ mm, $d_1=0.1$ mm, $T_2=0.3$ mm, $D_2=0.65$ mm, $t_2=0.03$ mm, $d_2=0.03$ mm, $T_3=0.25$ mm and $D_3=0.65$ mm, the amount of beam current passing through the second grid aperture 47 changes as shown in FIG. 10. Specifically, as the voltage $E_{c3}$ gradually increases from minus several tens of volts, the beam current increases substantially in proportion to the increase of the applied voltage and reaches a maximum at about 80 volts of $E_{c3}$ (point $\beta$ illustrated). With further increase of $E_{c3}$, the beam current decreases. Accordingly, in the ABO operation in which a positive voltage is applied as the pulse voltage, it is desirable that a normal operating point near a point $\alpha$ ($E_{c3}=0$ volt) be selected and an ABO operating point near the point $\beta$ ($E_{c3}=80$ volts) be selected. Although the points $\alpha$ and $\beta$ are variables dependent on the electrode structure, an exemplary voltage application is such that the DC voltage $V_{c3}$ normally applied to the intermediate grid is approximately minus 20 to plus 20 volts and is added to a positive pulse voltage $v_{c3}$ to provide a peak value of $E_{c3}$ applied in the ABO operation which is about 60 to 130 volts. For example, for $V_{c3}$ of about zero volt, $v_{c3}$ of about 80 volts and $E_{c3}$ of about 80 volts, a large beam current of 4 $\mu$A or more could be obtained in the ABO operation.

During the ABO operation, a negative voltage may be applied as the pulse voltage. In this case, the normal operating point near a point $\gamma$ ($E_{c3}=200$ volts) and the ABO operating point near the point $\beta$ may preferably be chosen. An exemplary voltage application is such that the DC voltage $V_{c3}$ is set to about 150 to 250 volts and added to a negative pulse voltage $v_{c3}$ to provide a peak value of $E_{c3}$ applied in the ABO operation which is about 60 to 130 volts. For example, for $V_{c3}$ of 200 volts, $v_{c3}$ of minus 120 volts and $E_{c3}$ peak value of 80 volts for the ABO operation, a large current of 4 $\mu$A or more could be obtained.

Figure 11:
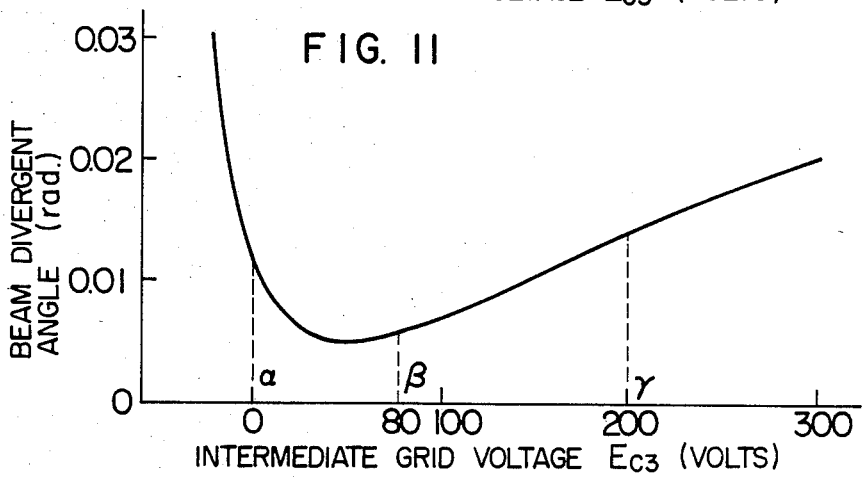
FIG. 11 is a diagram showing the relation between the voltage applied to the intermediate grid and the beam divergent angle.

FIG. 11 graphically shows the dependency of the divergent angle of the electron beam passing through the aperture 47 upon the voltage $E_{c3}$ applied to the intermediate grid in the electron gun of example 3. In the television camera tube, the beam divergent angle should desirably be suppressed to less than about 1° (0.017 rad) from the standpoint of deflecting aberration. As clearly be seen from FIG. 11, the beam divergent angle in the present embodiment is suppressed to 0.017 rad or less over a wide range extending from an operating point $\alpha$ to an operating point $\gamma$ and is compatible with the above requirement, having no adverse influence upon the deflecting aberration during both the normal and ABO operations.

Figure 12:
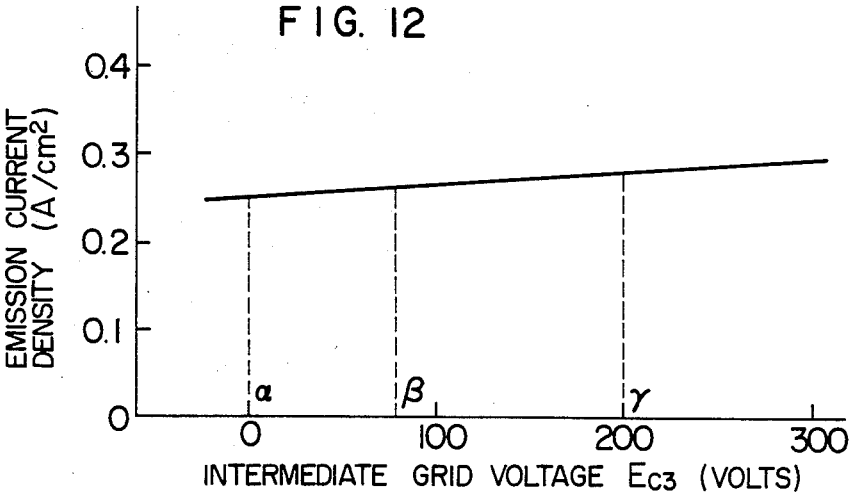
FIG. 12 is a diagram showing the relation between the voltage applied to the intermediate grid and the emission current density from the cathode.

FIG. 12 graphically shows values of emission current density on intersections with the center axis 0 of the cathode when the voltage $E_{c3}$ applied to the intermediate grid is varied. Since the change in the current density is about 18% over a range of $E_{c3}$ of from minus 20 volts to plus 300 volts, the cathode emission current density in the electron gun of the invention remains substantially constant when the voltage applied to the intermediate grid is varied from the normal operating point (point $\alpha$ or $\gamma$) to the ABO operating point (point $\beta$).

As described above, according to this embodiment, the voltage applied to the first grid opposing the cathode is kept constant during both the normal and ABO operations and a large beam current can therefore be obtained without causing the cathode emission current density to appreciably change, thereby attaining such meritorious effects as prolonged life and improved reliability of the cathode.

Figure 13:
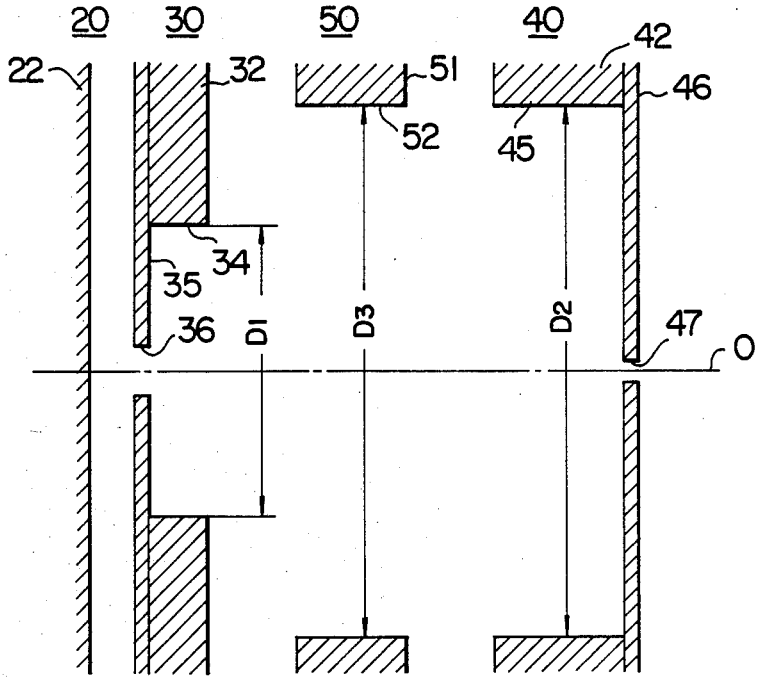
FIGS. 13 to 15 are enlarged sectional views showing still further embodiments of the invention, respectively.
Figure 14:
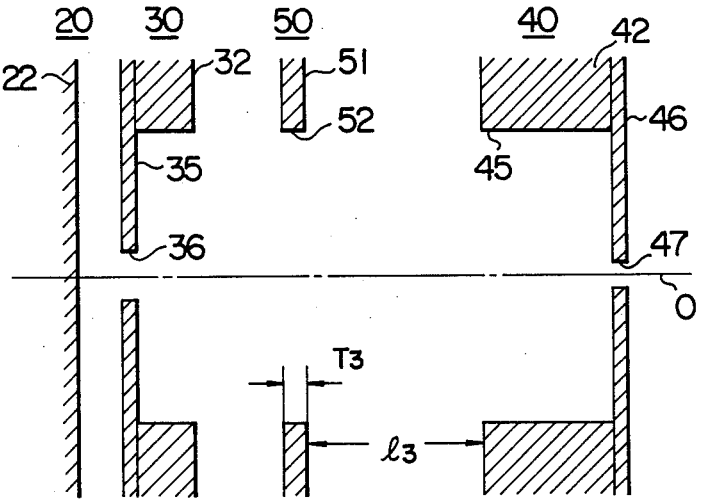
Figure 15:
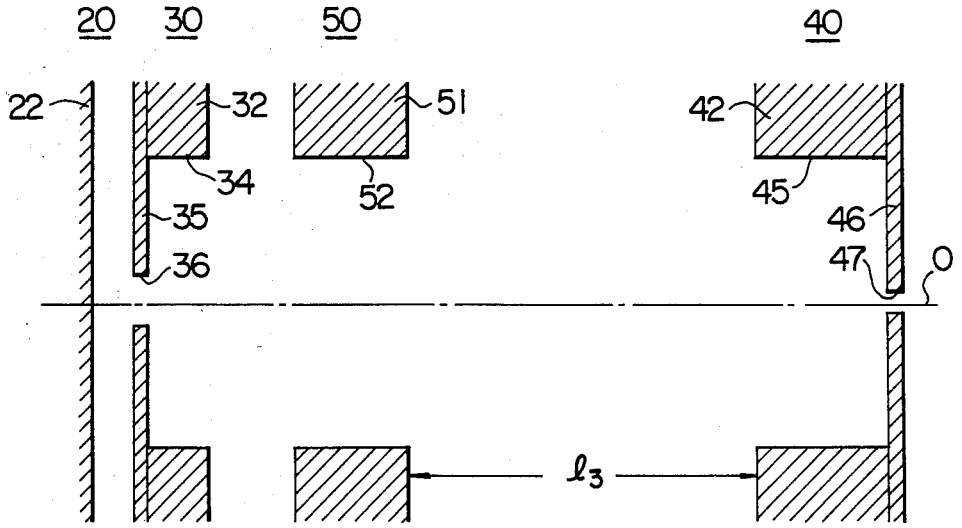

With reference to FIGS. 13, 14 and 15, still further embodiments of the invention will be described. In an embodiment of FIG. 13, a hole 52 in a disk 51 constituting an intermediate grid 50 has a diameter $D_3$ and a hole 45 bored in a disk block 42 of a second grid 40 has a diameter $D_2$ and these diameters are made larger than the diameter $D_1$ of a hole (recess) 34 in a disk block 32 of a first grid 30, amounting to 1.2 mm (the diameter $D_1$ is 0.65 mm). The other electrode dimensions are the same as these in example 3. In the embodiment of FIG. 14, the thickness $T_3$, of a disk 51 constituting an intermediate grid 50 is reduced to 0.05 mm and a gap $l_3$, between the intermediate grid 50 and a second grid 40 is set to 0.4 mm, with the other electrode dimensions being the same as those in example 3. In the embodiment of FIG. 15, a second grid 40 is kept remote from an intermediate grid 50 and a gap $l_3$, between the second grid 40 and the intermediate grid 50 is set to 1.25 mm, with the other electrode dimensions being the same as those in example 3. In these embodiments, the beam current characteristics, beam divergent angle characteristics and emission current density characteristics are substantially the same as those in example 3, and the amount of electron beam current can be increased without appreciable change of the cathode emission current density. Accordingly, it will be appreciated that the invention is applicable to the diode type electron gun comprised of the cathode, first grid, intermediate grid and second grid irrespective of the electrode dimensions.

While the foregoing embodiments have been described by way of examples as having only one intermediate grid, it should be recognized that the invention may incorporate a plurality of intermediate grids.

We claim:

1. A cross-over type diode electron gun for a television camera tube comprising:

a cathode for emitting electrons along a beam axis;

a first grid for being supplied with a positive voltage relative to the cathode and being disposed subsequently to said cathode along the beam axis and having a first aperture for passing electrons emitted from said cathode;

a second grid for being supplied with a higher positive voltage than that supplied to said first grid and being disposed subsequently to the first grid along the beam axis and having a second aperture disposed parallel to and coaxial with said first aperture; and means for forming a divergent electron lens near said first aperture between said first and second grids to cause the paths of said electrons to cross over on the beam axis at a point of high potential between said divergent electron lens and said second aperture.

2. An electron gun for a television camera tube according to claim 1 wherein said first grid comprises a disk block with a recess centered with said first aperture, and wherein the recess has a depth which is ½ or more of its inner diameter, said recess shielding electric fields generated by said second grid to form said divergent electron lens.

3. An electron gun for a television camera tube according to claim 2 wherein said first grid comprises a first electrode having a plate portion which has a hole of a diameter larger than that of said first aperture and opposes an electron emission surface of said cathode substantially in parallel therewith, and a second electrode disposed between said cathode and said first electrode for electrical connection therewith and having said first aperture, said second electrode partly closing said hole in the plate portion of said first electrode to form said recess.

4. An electron gun for a television camera tube according to claim 1, wherein an intermediate grid for being supplied with a voltage equal to or lower than that supplied to said first grid is disposed between said first and second grids and having a hole therein on the gun axis, thereby forming said divergent electron lens.

5. An electron gun for a television camera tube according to claim 4 wherein the voltage applied to said intermediate grid is equal to that applied to said cathode.

6. A cross-over type electron gun for a television camera tube comprising:

a cathode for emitting electrons;

a first grid for being supplied with a positive voltage relative to the cathode and being disposed subsequently to the cathode and having a first aperture therein;

a second grid for being supplied with a higher positive voltage than that supplied to said first grid and being disposed subsequently to the first grid and having a second aperture therein; and means for forming a divergent electron lens between said first and second grids to cause the paths of said electrons to cross over on the beam axis at a point of high potential between said divergent electron lens and said second aperture, including an intermediate grid interposed between said first and second grids and having a hole in alignment with said first and second apertures, and means supplying said intermediate grid with a voltage equal to or smaller than that supplied to said first grid.

7. An electron gun for a television camera tube according to claim 6 wherein the voltage supplied to said intermediate grid is equal to the potential of said cathode.

8. An electron gun for a television camera tube according to claim 6, including means for controlling the voltage supplied to said first grid to control the amount of electron beam current passing through said second aperture.

9. An electron gun for a television camera tube according to claim 7, including means for controlling the voltage supplied to said first grid to control the amount of electron beam current passing through said second aperture.

10. An electron gun for a television camera tube according to claim 8 wherein the voltage supplied to said first grid is controlled within a range of 3 to 15 volts.

11. An electron gun for a television camera tube according to claim 6 wherein the voltage supplied to said intermediate grid is conrrolled to control the amount of electron beam current passing through said second aperture.

12. An electron gun for a television camera tube according to claim 11 wherein a pulse voltage is applied to said intermediate grid to increase the amount of said electron beam current.

13. An electron gun for a television camera tube according to claim 12 wherein the voltage applied to said intermediate grid is 60 to 130 volts when added to the pulse voltage.

14. An electron gun for a television camera tube according to claim 11 wherein said electron beam has a divergent angle of less than about 1°.

15. An electron gun for a television camera tube according to claim 11 wherein said intermediate grid is disposed near said first grid.

16. An electron gun for a television camera tube according to claim 15 wherein said intermediate grid is spaced apart from said first grid by 0.1 to 0.5 mm.

17. An electron gun for a television camera tube according to claim 6 wherein said first grid comprises a first electrode having a plate portion which has a hole of a diameter larger than that of said first aperture and opposes an electron emission surface of said cathode substantially in parallel therewith, and a second electrode disposed between said cathode and said first electrode for electrical connection therewith and having said first aperture; said intermediate grid comprises a third electrode having said hole and disposed substantially in parallel with said plate portion of said first grid; and said second grid comprises a fourth electrode having a plate portion with a hole of a diameter larger than that of said second aperture and in opposition to said third electrode substantially in parallel therewith, and a fifth electrode electrically connected to the fourth electrode on one surface thereof opposite to said cathode and having said second aperture.

18. An electron gun for a television camera tube according to claim 17 wherein said second grid further comprises a sixth electrode formed with a hole of a diameter substantially equal to that of the hole in said plate portion of said fourth electrode and opposing said plate portion substantially in parallel therewith, and said fifth electrode is electrically connected to said fourth electrode through said sixth electrode.

19. An electron gun for a television camera tube according to claim 17 wherein the diameter of said hole in said plate portion of said fourth electrode is larger than the diameter of said hole in said third electrode of said intermediate grid.

20. An electron gun for a television camera tube according to claim 18 wherein the diameter of said hole in said plate portion of said fourth electrode is larger than the diameter of said hole in said third electrode of said intermediate grid.

21. An electron gun for a television camera tube according to claim 4, including means for supplying a controlled amount of voltage to said intermediate grid to control the amount of electron beam current passing through said second aperture.

22. An electron gun for a television camera tube according to claim 22, further including means for selectively applying a pulse voltage to said intermediate grid selectively to increase the amount of said electron beam current.

23. A cross-over type diode electron gun comprising a cathode for emitting electrons along a beam axis, first and second grids disposed along said beam axis in succession for being supplied with positive potentials to cause the paths of electrons emitted from said cathode to cross over on the beam axis between said first and second grids, and means for forming a divergent lens near said first grid so as to cause said cross-over of said electrons on said beam axis to occur at a point of high potential which is remote from said first grid and is located between said divergent lens and said second grid on said beam axis.

* * * * *